US007232009B1

(12) United States Patent
White et al.

(10) Patent No.: US 7,232,009 B1
(45) Date of Patent: Jun. 19, 2007

(54) ASCENSION/DESCENSION APPARATUS AND METHOD

(75) Inventors: Isaac D. White, Groveland, FL (US); Tracey L. Selig, Oviedo, FL (US)

(73) Assignee: Bell South Intellectual Property Corporation, Wilmington, DE (US)

( * ) Notice: Subject to any disclaimer, the term of this patent is extended or adjusted under 35 U.S.C. 154(b) by 230 days.

(21) Appl. No.: 10/679,843

(22) Filed: Oct. 6, 2003

(51) Int. Cl.
*E04G 3/00* (2006.01)
*B66B 9/00* (2006.01)

(52) U.S. Cl. ..... 182/37; 182/82; 182/142; 182/133; 187/239

(58) Field of Classification Search ..... 182/82, 182/141, 142, 37, 133; 187/239
See application file for complete search history.

(56) References Cited

U.S. PATENT DOCUMENTS 3,088,545 A * 5/1963 Meyer ..... 187/239
3,831,711 A * 8/1974 Smith ..... 182/40
4,073,382 A * 2/1978 Fahey et al. ..... 211/1
4,270,459 A 6/1981 Schwarzkopf
4,321,983 A 3/1982 Nelson
4,469,198 A * 9/1984 Crump ..... 182/141
5,497,855 A * 3/1996 Moore ..... 187/239
6,527,088 B1 * 3/2003 Fowler ..... 187/239
6,619,432 B1 * 9/2003 Yasui ..... 187/250
6,779,634 B1 * 8/2004 Slagle ..... 187/251

* cited by examiner

*Primary Examiner*—Alvin Chin-Shue
(74) *Attorney, Agent, or Firm*—Potomac Patent Group PLLC

(57) ABSTRACT

A pole ascension apparatus and associated method are disclosed. According to one embodiment, the apparatus includes a track connected to a pole and a portable platform portion detachably connectable to the track. The portable platform portion may move upwardly and downwardly along the track.

11 Claims, 4 Drawing Sheets

ASCENSION/DESCENSION APPARATUS AND METHOD

BACKGROUND

The present invention is directed generally to various embodiments of ascension/descension apparatuses and methods.

Telephone service technicians are often required to climb telephone poles in order to make the necessary repairs. As most telephone poles are wooden, it is common for telephone service technicians to use spiked shoes (often referred to as "gaffs") in order to provide the necessary traction to scale the vertical pole. Such shoes, however, often put unnecessary stress on the technician's leg and foot joints.

It can be appreciated that commercial entities and other organizations that employ workers in elevated environments are aware of the potential risks attendant upon work performed in such environments. In view of this awareness, commercial entities and other organizations devote time and resources to promoting the safety of workers performing work in elevated environments to make the performance of work as safe as possible. Promoting safety of workers in elevated environments may involve instituting training programs and/or providing workers with a variety of support devices, support systems, backup devices and systems, and/or other means that promote the stability and safety of workers in elevated environments. Despite the best efforts of an organization to enhance the safety of its workers and reduce the risk of falling from elevated structures, for example, it is nonetheless difficult to eliminate all risks to workers performing work on such elevated structures.

Redundant systems for promoting safety of workers on elevated utility structures may thus sometimes be used. Such redundant systems can sometimes be beneficial in addition to the myriad of existing support systems, methods, devices and/or other apparatus employed by workers on elevated structures to reduce or mitigate risks associated with falling from utility structures, for example.

SUMMARY

In one general respect, embodiments of the present invention include an ascension/descension apparatus. According to various embodiments, the apparatus includes a track connected to a vertical surface and a portable platform portion detachably connectable to the track. The portable platform portion may move upwardly and downwardly along the track. In addition, the apparatus may include a chain system connected to the vertical surface for raising and lowering the portable platform portion along the track. In operation, therefore, an operator of the apparatus may connect the platform to the track and then activate the chain system to ascend, and subsequently descend, the pole. When finished at the pole, the operator may then remove the platform. As such, the apparatus may be convenient to service technicians who need to ascend poles, such as telephone poles, in an expedient manner.

According to various embodiments of the apparatus, the portable platform portion may include a control unit connected thereto. The control unit may allow the operator to control the chain system from the portable platform device. For example, the control unit may include one or more pedals that allow the operator to control, for example, ascent or descent of the pole and/or vary the speed of platform in a hands-free manner. In addition, the control unit may communicate wirelessly with the chain system in order to control the chain system.

According to other embodiments, the apparatus may include a portable platform portion and means for raising and lowering the portable platform portion. The means for raising and lowering may be, for example, the track and chain system as described above or a hydraulic lift system.

In another general respect, various embodiments of the present invention are directed to a method of traversing a vertical surface (such as a utility pole). The method may include connecting a portable platform portion to the track and activating the chain system of the track to raise to the portable platform portion such that the portable platform portion ascends the vertical surface. In addition, the method may include activating the chain system to lower the portable platform portion such that the portable platform portion descends the vertical surface and disconnecting the portable platform portion from the track.

Other systems and/or methods according to embodiments will be or become apparent to one with skill in the art upon review of the following drawings and detailed description. It is intended that all such additional systems and/or methods be included with this description, be within the scope of the present invention, and be protected by the accompanying claims.

DESCRIPTION OF THE DRAWINGS

Embodiments of the present invention will be described in conjunction with the following figures, which are not drawn to scale, wherein.

DESCRIPTION

Figure 1:
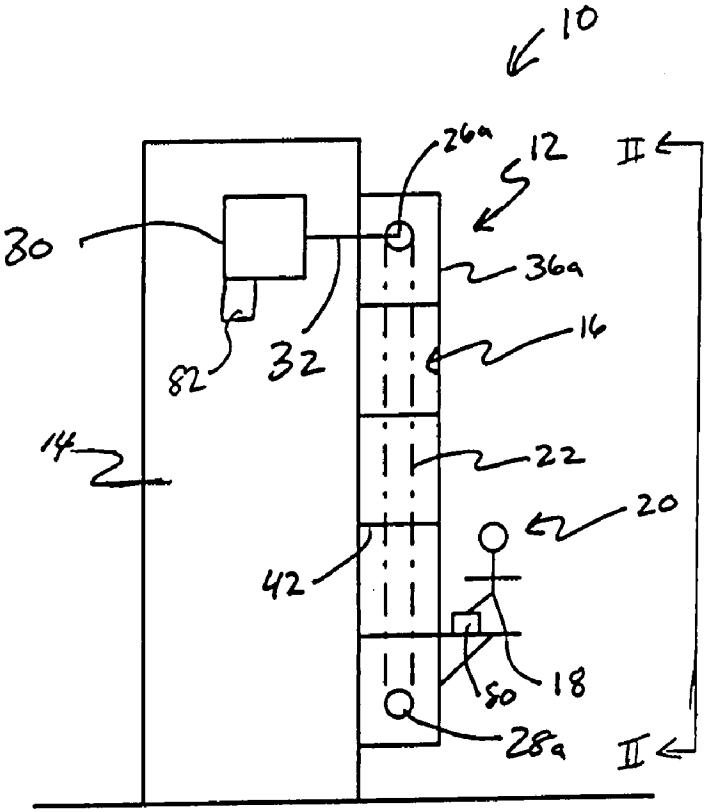
FIG. 1 is a side view of an ascension/descension apparatus according to various embodiments.

FIG. 1 is a side-view of an ascension/descension apparatus 10 according to various embodiments of the present invention. As can be seen in FIG. 1 the apparatus 10 includes a track 12 connected to a vertical or substantially vertical surface, such as, for example, a pole 14. A front view of the track 12 is shown in FIG. 2.

Figure 2:
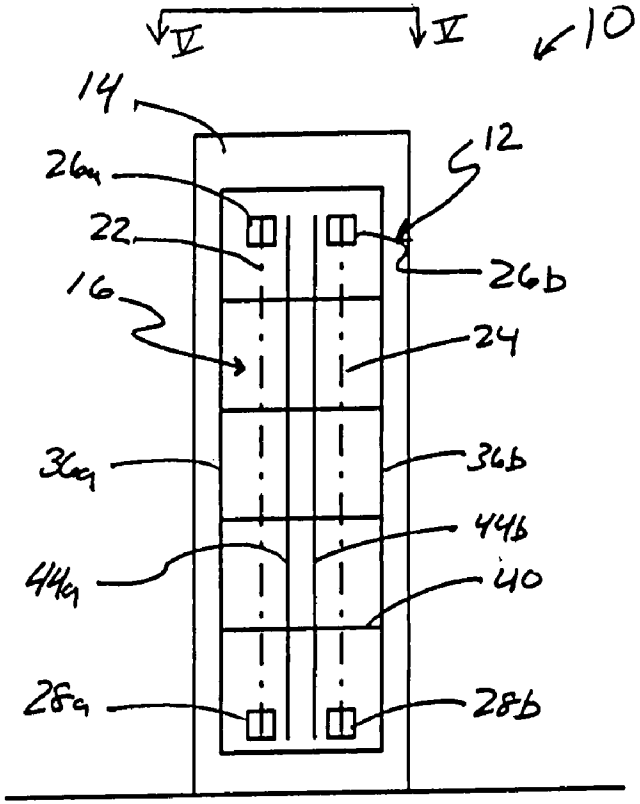
FIG. 2 is a front view of the ascension/descension apparatus of FIG. 1 according to various embodiments.

As can be seen with reference to FIGS. 1 and 2, the track 12 may include a chain system 16 for pulling up and lowering down a platform 18. The platform 18 may support a person 20, such as technician who needs to service equipment (not shown) connected to the pole 14. As described in more detail below, the platform 18 may be detachably connectable to the track 12.

The chain system 16 may include a pair of chains 22, 24. Each chain 22, 24 may be wound around and engaged by two drive gears: an upper drive gear $\mathbf{26}_{a,b}$ at the top of the chain system 16 and a lower gear drive $\mathbf{28}_{a,b}$ at the lower portion of the chain system 16. A drive shaft 32 connected to a motor 30, such as an electric motor, may turn the upper drive gears 28*a,b* to thereby rotate the respective chains 22, 24. As illustrated in FIG. 1, the motor 30 may be located near the upper drive gears $\mathbf{26}_{a,b}$. According to other embodiments, the motor 30 may be located near and drive the lower drive gears $\mathbf{28}_{a,b}$. The motor 30 may be powered by any suitable power source (not shown), including, for example, a battery, a generator or solar cells.

The pole 14 may be, for example, a utility pole such as, for example, a telephone pole, an electrical power line pole, a light pole etc., to which utility, for example, equipment (such as telephone network equipment, electrical power equipment, or light fixtures) may be connected. In that connection, the pole 14 may be made out of any material suitable for purposes of, for example, withstanding environmental conditions and being able to support the utility equipment. According to various embodiments, the pole 14 may be made of steel, wood and/or concrete.

As seen in FIG. 2, the track 12 may include two vertical and parallel rails $\mathbf{36}_{a,b}$. As described in more detail below, the rails 36*a,b* may have a curved outer surface over which a portion of the platform 18 may sit such that the platform 18 may glide over the rails $\mathbf{36}_{a,b}$. In that connection, the platform 18 may include wheels or bearing to facilitate gliding along the rails $\mathbf{36}_{a,b}$ when pulled or lowered by the chain 18. Also as seen in FIG. 2, the track 12 may include a number of inter-rail supports 40 connected between the rails $\mathbf{36}_{a,b}$. The inter-rail supports 40 may be behind the chain system 16, that is closer to the pole 14 than the chains 22, 24, so as to not interfere with the movement of the platform 18 as it rides along the rails $\mathbf{36}_{a,b}$ when being pulled by the chain system 16. The inter-rail supports 40 may also be connected to the pole 14 to help secure the track 12 to the pole 14. In addition, as seen in FIG. 1, the track 12 may include a number of supports 42 for connecting the track 12 to the pole 14. The supports 42, as seen in FIG. 1, may be long enough so as to extend past the chains 22, 24 of the chain system 16 in order that the platform 18 does not interfere with the movement of the platform 18 as it rides along the rails $\mathbf{36}_{a,b}$ when being pulled by the chain system 16.

In addition, the track 12 may include vertical and parallel guideposts $\mathbf{44}_{a,b}$ situated between the rails $\mathbf{36}_{a,b}$ for facilitating coordinated and unisoned movement of the respective chains 22, 24, as described in more detail below. The rails $\mathbf{36}_{a,b}$, the inter-rail supports 40, the supports 42 and the guideposts $\mathbf{44}_{a,b}$ may be made of, for example, metal and/or metal alloys. The track 12 may be connected to the pole 14 in any manner suitable for supporting the weight of the track 12, the platform 18 and the anticipated weight of the load supported by the platform 18. According to various embodiments, the track 12, such as the supports 42 and the inter-rail supports 40 may be bolted to the pole 12. In addition, according to various embodiments of the present invention, an existing pole 14, such as an existing telephone pole, may be retrofitted with the track 12. Alternatively, the track 12 may be integrated into the pole 14 when the pole 14 is made.

Figure 3:
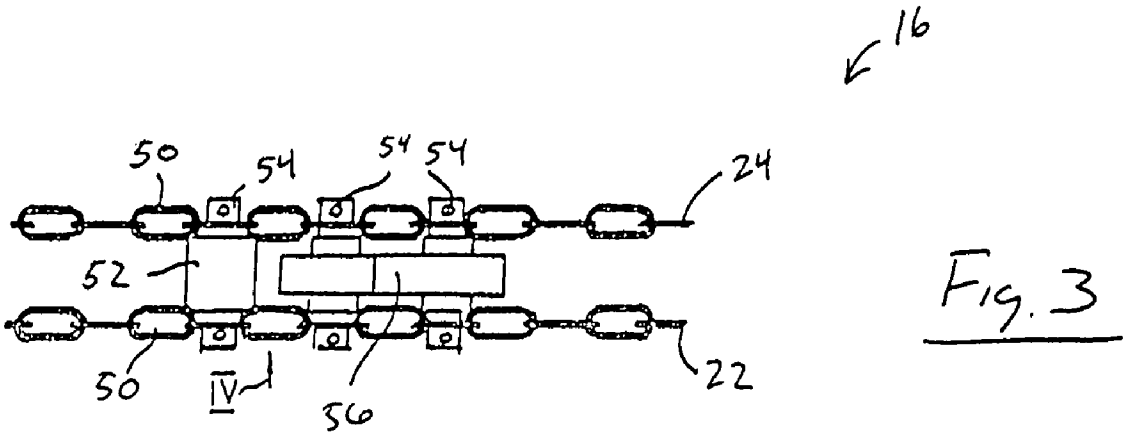
FIGS. 3 and 4 are views of a portion of a chain system according to various embodiments.
Figure 4:
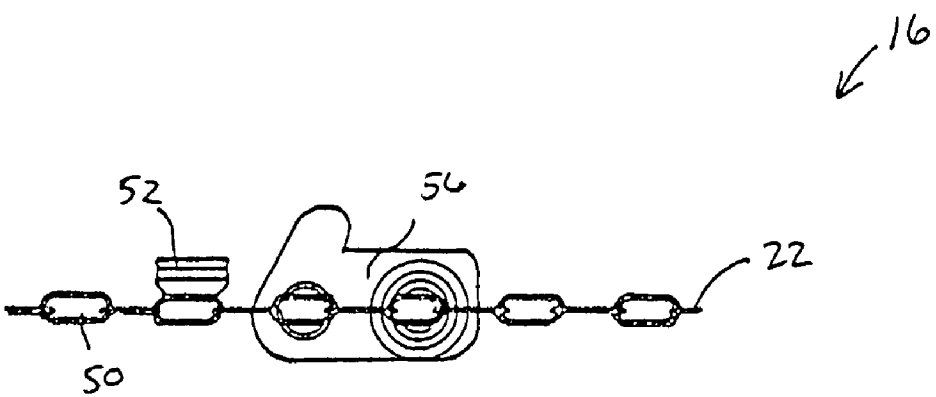

FIGS. 3 and 4 illustrate details regarding the chain system 16 according to various embodiments of the present invention. As seen in FIGS. 3 and 4, the chains 22, 24 may include a number of links 50. Further, the chain system 16 may include one or more shoes 52 connected between corresponding links 50 of the respective chains 22, 24. The shoes 52 may be attached to the chains 22, 24 by a bolt 54 passing through the corresponding links 50 and the shoe 52 so as to lock the links 50 together. The shoes 52 may be situated between the guideposts $\mathbf{44}_{a,b}$ so as to slide between the guideposts $\mathbf{44}_{a,b}$ to allow the chains 22, 24 to turn in unison along a controlled path.

In addition, as shown in FIGS. 3 and 4, the chain system 16 may include one or more platform engaging elements 56 for engaging, for example, a hook (or chain dog) 68 (shown in FIG. 5, to be discussed below) of the platform 18. The platform engaging elements 56 may be fastened to the chains 22, 24 with bolts 54 much like the shoes 52. The platform engaging elements 56 may engage the chain dog of the platform 18 so as to pull up or lower the platform 18.

Figure 5:
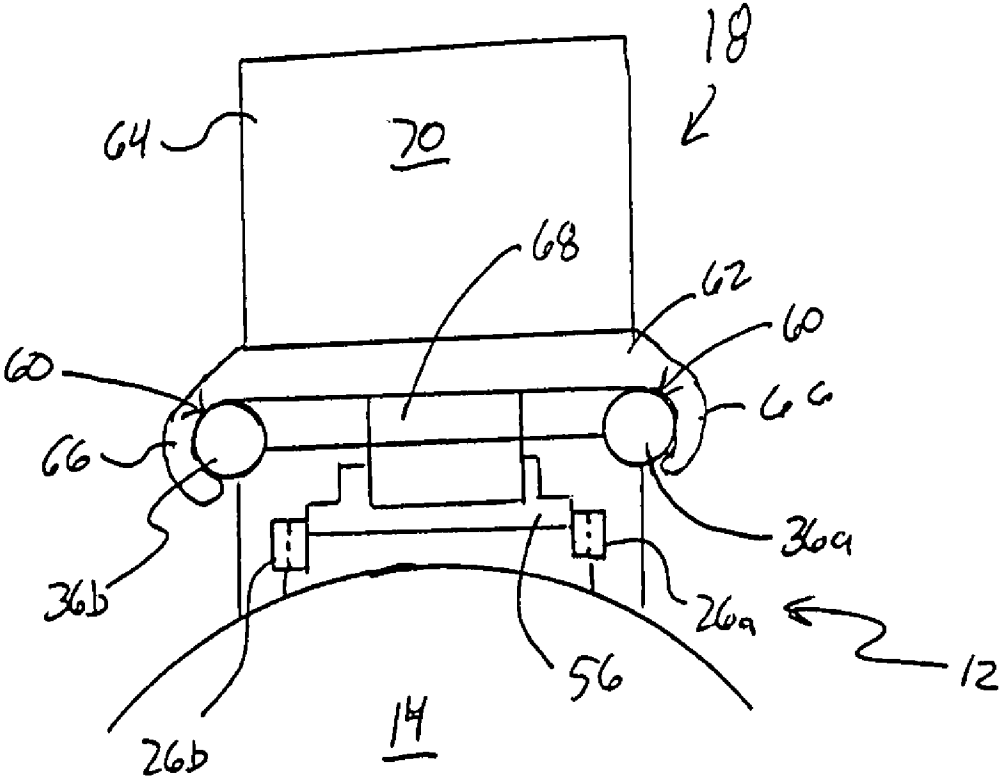
FIG. 5 is a top view of the ascension/descension apparatus of FIG. 1 according to various embodiments.

FIG. 5 illustrates a top view of the apparatus 10 according various embodiments. As can been seen in FIG. 5, the rails $\mathbf{36}_{a,b}$ may have curved outer surfaces 60. According to various embodiments, the platform 18 may comprise two portions—a fixed portion 62 and a detachable portion 64. The fixed portion 62 may remain movably fixed to the track 12 and may include flanges 66 positioned around the rails $\mathbf{36}_{a,b}$ such that the flanges may glidably move along the rails $\mathbf{36}_{a,b}$. The fixed portion 62 may further include a hook, or chain dog, 68 for engaging the platform engaging element 56 of the chain system 16 such that when the chains 22, 24 rotate forward, the platform engaging element 56 engages the chain dog 68 and pulls the platform 18 upward and, when the chains 22, 24 rotate backward, the platform engaging element 56 allows the chain dog 68, and hence the platform 18, to be lowered with the platform engaging element.

The detachable portion 64 of the platform may include an area 70 at which a person could stand. The detachable portion 64 may be detachably connectable to the fixed portion 62 of the platform 18 such that the operator 20 may connect the detachable portion 64 to the fixed portion 62 prior to ascending the pole 14 and then remove the detachable portion 64 when finished at the pole site. Any attachment mechanism for attaching the detachable portion 64 to the fixed portion 62 that is suitable for the intended purpose may be utilized. For example, the attachment mechanism may be strong enough to withstand the torque provided by the weight of the detachable portion 64 as well as the operator 20 and any equipment that may be positioned on the detachable portion 64. For example, the attachment mechanism may include one or a combination of nuts and bolts, tongue and groove channels, locking pins, etc.

According to various embodiments, the platform 18 may have one or more sidewalls (not shown) to surround or partially surround the standing area 70 to provide safety from falls for the operator 20. In addition, according to various embodiments, the platform 18 may include only one piece that the operator 20 can fit over the rails $\mathbf{36}_{a,b}$, rather than the two portions 62, 64 as illustrated in FIG. 5. According to such embodiments, the operator 20 may connect the platform 18 to the track 12 to traverse the pole 14 rather than attaching the detachable portion 64 to the fixed portion 62 as shown in FIG. 5.

The operator 20 may control the motor 30, and hence rotation of the chains 22, 24, with a control unit 80 (FIG. 1). The control unit 80 may be, for example, mounted to the platform 18, such as to the detachable portion 64 or the fixed portion 62. The control unit 80 may be in communication with a motor control unit 82 connected to the motor 30 by, for example, a wireless or wire connection. The motor control unit 82 may receive the signals from the control unit 80, entered by the operator 80, and cause the motor to perform the commanded operation, such as rotate (forward or backward), stop rotating, or change speed of rotation.

For embodiments in which the control unit 80 is in communication with the motor control unit 82 wirelessly, the control unit 80 may communicate with the motor control unit 82 with, for example, optical or radio signals. According to one embodiment, the control unit 80 may communicate with the motor control unit 82 via Bluetooth communication signaling. For embodiments in which the control unit 80 is connected to the motor control unit 82 via a wire connection, the motor control unit 82 may have communication wires running down the pole 14 and which connect to a port (not shown) on the track system 12. The control unit 80 may have lead wires for connecting to the port, thus interconnecting the control unit 80 and the motor control unit 82 (and hence the motor 30).

Via the control unit 80, the operator 20 may control the motor 30, such as causing the motor 30 to rotate the chains 22, 24 (both forward and backward), thus causing the motor 30 to cease rotating the chains 22, 24, and/or varying the speed of rotation. The control unit 80 may include any type of input interface suitable to permit the operator to control the motor 30 from the control unit 80. For example, the control unit 80 may have one or more pedals to allow the operator 20 to control the motor 30 hands-free. According to various embodiments, the control unit 80 may include, for example, one or more of a keyboard, a mouse, a trackball, a touch-screen interface, a joystick, a touchpad, etc., to permit the operator 20 to input commands to the control unit 80 to control the motor 30. In addition, according to other embodiments, the control unit 80 may have speech recognition software such that the control unit 80 could recognize verbal commands from the operator 20.

In operation, therefore, a technician or other person required to ascend the pole 14, for example, to service equipment mounted to the pole 14, may connect the detachable platform portion 64 to the track system 16 and then control the motor 30 via the control unit 80 to both ascend and descend the pole 14. Once finished at the site, the operator may disconnect the detachable platform portion 64.

Security mechanisms may be used in order that only appropriate operators can control the motor 30. For example, for embodiments where the control unit 80 communicates with the motor control unit 82 wirelessly, the operator 20 may be required to enter a personal identification number (PIN) to be authenticated by the motor control unit 82. According to other embodiments, a coded enable signal may be sent to the motor control unit 82 in order to enable the control unit 80 to be able to communicate with the motor control unit 82. For embodiments in which the motor control unit 82 is hard-wired to the control unit 80, the interface port, described above, may have, for example, a locked entry which must be opened to allow the operator 20 to connect the control unit 80 to the interface port.

Figure 6:
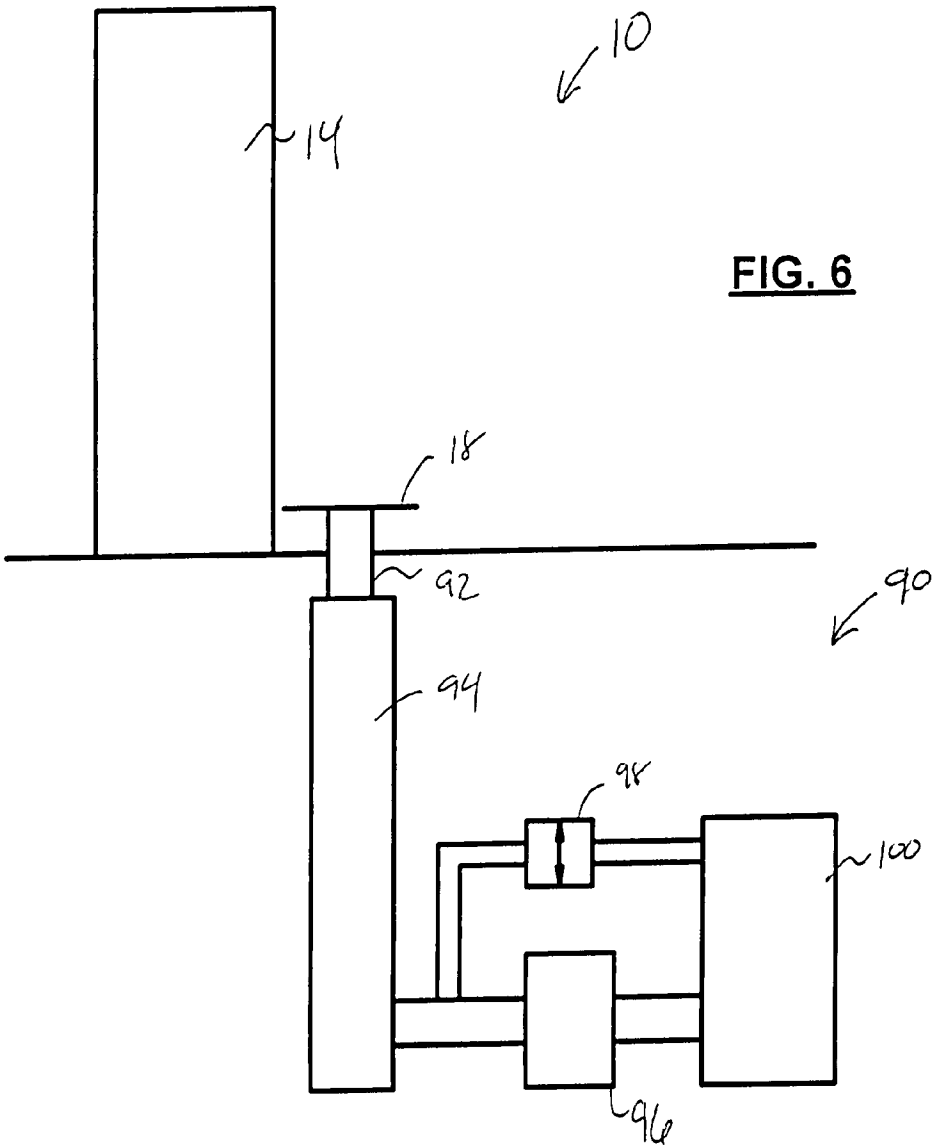
FIG. 6 is a diagram of the ascension/descension apparatus according to other various embodiments.

According to other embodiments, different mechanisms may be used to raise and lower the portable platform portion. For example, the apparatus 10 may include a hydraulic lift system 90, as shown in FIG. 6. The hydraulic lift system 90 may include, for example, a piston 92, a cylinder 94, a pump 96, a valve 98 and a reservoir of hydraulic fluid 100, and may operate, for example, like a conventional hydraulic lift system. The operator 20 may detachably connect the platform 18 to the piston 92 when it is desired to ascend the pole 14. For security purposes, access to the cylinder 92 to which to connect the platform 18 may require, for example, a keyed and/or verified (e.g., PIN) entry. According to other embodiments, the apparatus 10 may include, for example, a block-and-tackle system for raising and lowering the portable platform portion.

What is claimed is:

1. An ascension/descension apparatus, comprising:

a track connected to a vertical surface of a utility pole;

a portable platform portion detachably connectable to the track such that the portable platform portion can move upwardly and downwardly along the track; and a chain system connected to the track for raising and lowering the portable platform portion wherein the track includes two vertical rails parallel to each other and connected to each other by a plurality of inter-rail supports, the supports being connected to the pole for securing the track to the pole.

2. The ascension/descension apparatus of claim 1, wherein the chain system includes at least one chain, and further comprising a motor for rotating the chain.

3. The ascension/descension apparatus of claim 2, further comprising a control unit connected to the portable platform portion such that an operator of the apparatus can control the motor from the control unit.

4. The ascension/descension apparatus of claim 3, further comprising a motor control unit in communication with the control unit and the motor, wherein the motor control unit is for receiving signals from the control unit.

5. The ascension/descension apparatus of claim 4, wherein the control unit is in wireless communication with the motor control unit.

6. The ascension/descension apparatus of claim 1 wherein utility equipment is connected to the utility pole.

7. The ascension/descension apparatus of claim 6, wherein the utility pole is a telephone pole.

8. An ascension/descension apparatus, comprising:

a portable platform portion; and means for raising and lowering the portable platform, the means including:

a track attached to a vertical surface of a utility pole, wherein the portable platform portion is detachably connectable to the track;

a chain system for moving the portable platform portion along the track; and a motor in communication with the chain system wherein the track includes two vertical rails parallel to each other and connected to each other by a plurality of inter-rail supports, the supports being connected to the pole for securing the track to the pole.

9. The ascension/descension apparatus of claim 8, further comprising a control unit connected to the portable platform portion such that an operator of the apparatus can control the motor from the control unit.

10. The ascension/descension apparatus of claim 9, further comprising a motor control unit in communication with the control unit and the motor, wherein the motor control unit is for receiving signals from the control unit.

11. The ascension/descension apparatus of claim 10, wherein the control unit is in wireless communication with the motor control unit.

* * * * *